US009284810B2

(12) United States Patent
Bryson et al.

(10) Patent No.: US 9,284,810 B2
(45) Date of Patent: Mar. 15, 2016

(54) FLUID INJECTION SYSTEM AND METHOD

(75) Inventors: William Thomas Bryson, Montrose (GB); Michael Adrian Wenham, Aberdeenshire (GB); Robert Bell, Aberdeen (GB)

(73) Assignee: Vetco Gray U.K., Limited, Houston, TX (US)

( * ) Notice: Subject to any disclaimer, the term of this patent is extended or adjusted under 35 U.S.C. 154(b) by 480 days.

(21) Appl. No.: 13/587,257

(22) Filed: Aug. 16, 2012

(65) Prior Publication Data

US 2014/0048269 A1 Feb. 20, 2014

(51) Int. Cl.
*E21B 33/068* (2006.01)
*E21B 34/02* (2006.01)
*E21B 21/10* (2006.01)

(52) U.S. Cl.
CPC ..... *E21B 33/068* (2013.01); *E21B 34/02* (2013.01); *E21B 21/10* (2013.01)

(58) Field of Classification Search
CPC ..... E21B 33/068; E21B 37/06; E21B 34/02; E21B 21/10
USPC ..... 166/312, 90.1, 88.4, 95.1
See application file for complete search history.

(56) References Cited

U.S. PATENT DOCUMENTS

| | | | | |
|---|---|---|---|---|
| 4,625,797 | A | 12/1986 | Tsutsumi et al. | |
| 5,971,077 | A | 10/1999 | Lilley | |
| 7,240,736 | B2 * | 7/2007 | Fenton et al. | 166/358 |
| 7,740,074 | B2 | 6/2010 | White et al. | |
| 2002/0011336 | A1 * | 1/2002 | Baskett et al. | 166/368 |
| 2003/0089501 | A1 * | 5/2003 | Hartmann | 166/348 |
| 2004/0104024 | A1 * | 6/2004 | Kent et al. | 166/85.4 |
| 2008/0169097 | A1 * | 7/2008 | Bolding et al. | 166/263 |
| 2009/0266542 | A1 * | 10/2009 | Donald et al. | 166/279 |
| 2010/0025044 | A1 * | 2/2010 | McKay et al. | 166/359 |
| 2011/0155384 | A1 * | 6/2011 | Wright et al. | 166/357 |

FOREIGN PATENT DOCUMENTS

| | | | |
|---|---|---|---|
| NO | 20110765 | A | 1/2012 |
| WO | 2008034024 | A2 | 3/2008 |
| WO | 2012161585 | A1 | 11/2012 |

OTHER PUBLICATIONS

PCT Search Report and Written Opinion dated Nov. 19, 2013 from corresponding Application No. PCT/EP2013/067193.

* cited by examiner

*Primary Examiner* — Robert E Fuller
*Assistant Examiner* — Christopher Sebesta
(74) *Attorney, Agent, or Firm* — Bracewell LLP

(57) ABSTRACT

A system for injecting fluids into a well having a fluid supply line that is connected to a mandrel at the top of the production tree. The system is designed so that all components of the system are packaged together and run to the production tree in one run. The production tree is designed to provide a pathway for the fluid to travel from the mandrel to the production bore within the tree, and then into the production tubing of a well.

17 Claims, 2 Drawing Sheets

FLUID INJECTION SYSTEM AND METHOD

BACKGROUND OF THE INVENTION

1. Field of the Invention

This invention relates generally to the injection of fluid into oil and gas wells. In particular, this invention relates to the delivery of fluid to a well through a production tree mounted on the well, by injecting the fluid through a mandrel in the production tree.

2. Brief Description of Related Art

The production of oil and gas from some wells may lead to contact between compounds in hydrocarbon rock formations, and those present in oilfield process fluids, such as, for example, seawater. This contact may lead to the formation of "scale", or salts that clog the formation and inhibit hydrocarbons in the formation from entering the well. Accordingly, scale inhibitors are sometimes introduced into a well to control or prevent scale deposition. In some cases, scale inhibitors may be combined with fracture treatments, whose purpose is to crack the formation and facilitate the release of hydrocarbons into the well.

The fluids used to inhibit scaling and to cause fracturing (hereinafter referred to as scale squeeze fluid, or just fluid) are typically introduced to the well through the choke of a production tree attached to the well. From the choke, the fluid may enter the production bore of the tree, the production tubing of the well, and ultimately the formation in need of de-scaling/fracturing. However, there are problems associated with introducing the fluid through a choke on the production tree.

For example, when the fluid is introduced through the choke, the capacity of the choke to carry out other functions, such as managing pressure within the well, may be reduced or eliminated. In addition, introduction of the fluid through the choke requires a special choke insert adapted for interface with a landing module that delivers the fluid. Retrofitting the choke to accept the special choke insert can be a complicated process that requires multiple steps. The steps include running guide posts, running a remote component replacement (RCR) tool to remove any old choke inserts, running an RCR tool to insert the special choke insert, running a scale squeeze module, injecting the scale squeeze fluid, recovering the module, and capping the scale squeeze adapter.

Accordingly, there is a need for a fluid injection system and process that overcomes the disadvantages of the prior art.

SUMMARY OF THE INVENTION

Disclosed herein is a fluid injection system in which the fluid is injected not into the choke of a production tree, but directly into a mandrel at the top of the tree. A pathway is provided within the production tree for the fluid to travel from the mandrel to the production bore within the tree, and then into the production tubing of a well.

Also disclosed herein is a process for injecting fluid into a well by injecting the fluid directly into the mandrel at a production tree mounted to the well. The process includes attaching a fluid supply line to the mandrel of the production tree with a connector. In one embodiment, all of the components necessary to connect the fluid supply line to the mandrel, and to control the flow of fluid through the fluid supply line, are included in one package, so that installation of the fluid injection system requires only one trip to deliver the package and install the components of the system at the production tree.

BRIEF DESCRIPTION OF THE DRAWINGS

The present invention will be better understood on reading the following detailed description of nonlimiting embodiments thereof, and on examining the accompanying drawings, in which.

DETAILED DESCRIPTION OF THE PREFERRED EMBODIMENT

Figure 1:
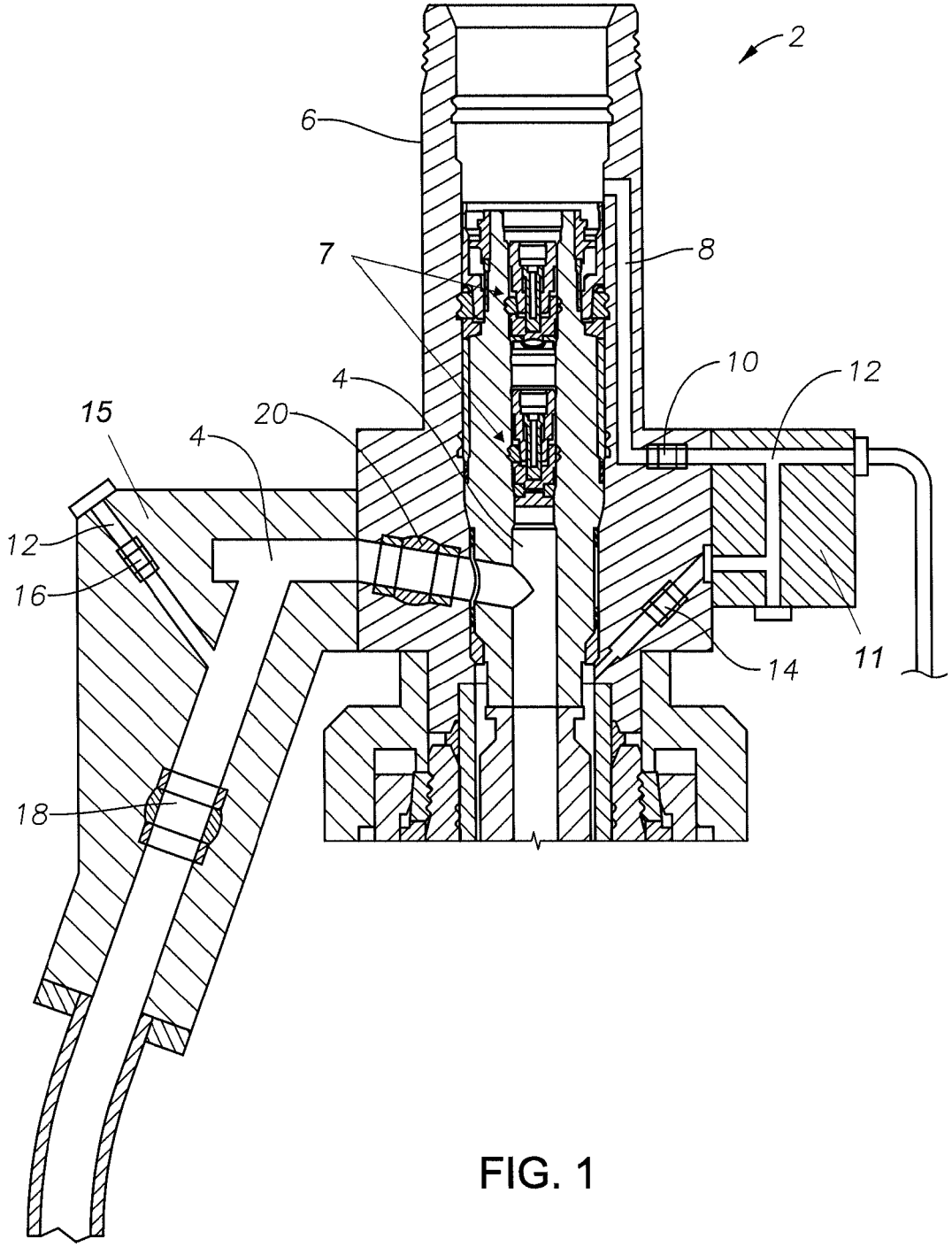
FIG. 1 is a schematic side cross-sectional view of an example embodiment of a production tree having a flow path from a mandrel at the top of a production tree to a production bore in the tree.

The system and method of the present disclosure will now be described more fully with reference to the accompanying drawings, in which example embodiments are shown, and wherein like reference numerals refer to like elements throughout. The subject matter of the present disclosure may, however, be embodied in many different forms and should not be construed as limited to the illustrated embodiments; rather, these embodiments are provided so that this disclosure will be thorough and complete, and will fully convey the scope of the invention to those skilled in the art.

It is to be understood that the subject of the present disclosure is not limited to the exact details or embodiments shown and described, as modifications and equivalents will be apparent to one skilled in the art. In the drawings and specification, there are disclosed illustrative embodiments of the subject disclosure and, although specific terms are employed, they are used in a generic and descriptive sense only and not for the purpose of limitation.

Referring to FIG. 1, there is shown a schematic side cross-sectional view of a production tree 2 according to one possible embodiment of the present invention. The production tree 2 has a production bore 4 in fluid communication with, and configured for attachment at a lower end to, the production tubing of a well (not shown). The production tree 2 also includes a mandrel 6 at an upper end. A pair of crown plugs 7 are positioned in the production tree 2 to prevent fluid flow from the production bore 4 to the mandrel 6. A fluid port 8 provides a pathway through the mandrel 6, and around the crown plugs 7, to an annulus wing block 11 through annulus access valve 10, and from the annulus access valve 10 to a crossover port 12. An annulus master valve 14 separates the crossover port 12 from the portion of the annulus below the annulus master valve 14.

The crossover port 12 provides a pathway from the annulus wing block 11 to a production wing block 15 through a crossover valve 16. The crossover port 12 intersects the production bore 4 at a location between a production wing valve 18 and a production master valve 20. The production wing valve 18 separates the crossover port 12 from the portion of the production bore upstream of the production wing valve 18. Each of the valves disclosed herein may be controlled by known methods. For example, the valves may be hydraulically controlled. Alternatively, the valves may be mechanically or electrically controlled.

One advantage to the production tree configuration shown in FIG. 1 is that fluid, such as, for example, scale squeeze fluid, may be introduced directly to the production bore 4 through the mandrel 6 of the production tree 2. One reason this direct injection through the mandrel 6 is advantageous is that it eliminates the need to introduce the fluid through a choke. This frees the choke for use for other purposes, such as controlling pressure within the well. Another advantage to introducing fluid to the production tree directly through the mandrel, and not the choke, is that when connecting the fluid lines, it is easier to land the connector (discussed in more detail below) on the mandrel than the choke.

Figure 2:
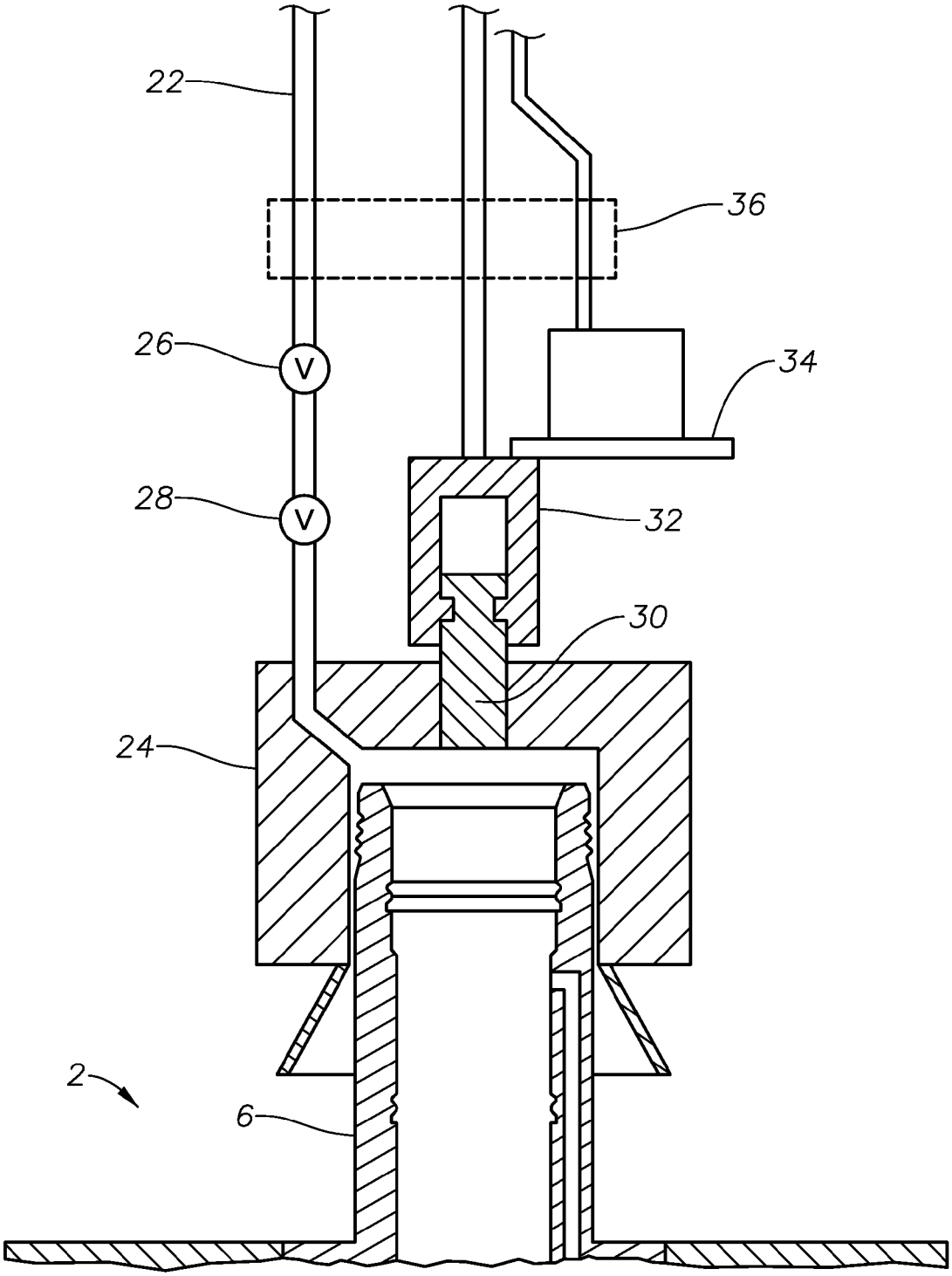
FIG. 2 is a schematic side cross-sectional view of an example embodiment of a fluid injection system arranged and designed to deliver a fluid to a mandrel at the top of a production tree.

FIG. 2 shows a schematic side cross-sectional view of a fluid injection system according to an embodiment of the present invention, where the fluid is introduced to the production tree 2 through a mandrel 6 at the top of the production tree 2. As can be seen, fluid may be brought to the fluid injection system by a fluid supply line 22 that connects the fluid injection system with a fluid source at another location (not shown), such as, for example, at the surface of the sea. The fluid supply line 22 communicates with the production tree 2 via a connector 24. In an example embodiment, the connector 24 is annular and includes clamps (not shown) on an inner circumference that can selectively attach on the outer circumference of the mandrel 6 of the production tree 2. In one embodiment, the connector 24 may be a MDH4 connector. The connector 24 is optionally adaptable for use with different function packages. In addition, different connectors may be used to connect the fluid supply line 22 to different types of production trees. For example, although the production tree shown in FIG. 1 is a horizontal tree, the fluid injection system of the present invention may also be used with trees having a vertical configuration.

As shown in FIG. 2, the fluid supply line 22 may include one or more valves to control the flow of fluid through the supply line 22. For example, the fluid supply line 22 may include an isolator valve 26 and/or a check valve 28, in addition, the fluid injection system may include additional components depending on the type and structure of the production tree 2. For example, if the production tree has a plug 30 in the top of the mandrel 6, the system may include a plug removal tool 32 such as that disclosed in, for example, U.S. Pat. Nos. 7,240,736 and 6,968,902. Similarly, a remotely operated vehicle (ROV) carrier 34 may be included in the system. Furthermore, the fluid injection system may include safety devices, such as, for example, an emergency quick disconnect 36 to ensure a secure disconnect.

One advantage to the fluid injection system shown in FIG. 2 is that all of the necessary structure (e.g., the supply line 22, isolator valve 26, check valve 28, emergency quick disconnect 36, ROV carrier 34, plug removal tool 32, and connector 24) can be placed in one trip, with just one land and lock of the connector. Thus, installation of the system of FIG. 2 is faster and more cost effective than the installation of known systems, many of which require running multiple parts and tools separately in order to connect fluid supply lines to the production tree.

With the structure of the production tree 2 and fluid injection system as shown in FIGS. 1 and 2, the flow path of fluid introduced through the system is as follows: First, the fluid travels from a fluid source to the connector 24 via fluid supply line 22. Then the fluid travels through the connector 24 and the mandrel 6 via the fluid port 8. The annular access valve 10 is open and the annulus master valve 14 is closed, so that the fluid travels through the annular access valve 10 and into the crossover port 12. Thereafter, with the crossover valve 16 open, the production access valve 18 closed, and the production master valve 20 open, the fluid travels through the crossover valve 16 and the production master valve 20 into the production bore 4. Thus, the fluid enters the production tree 2 through the mandrel 6 and ultimately into the production bore 4. From the production bore 4 the fluid travels into the production tubing of the well.

Another embodiment of the invention includes a method of injecting fluid into the production tubing of a well by introducing the fluid through a mandrel at the top of a production tree. First, the production tree is positioned at the top of the well, so that the production bore of the tree is in fluid communication with the production tubing in the well. In one embodiment, the production tree is designed as described above in reference to FIG. 1, with a flow path between a mandrel at the top of the tree and the production bore of the tree. A fluid supply line, such as that described above with respect to FIG. 2, is attached to the mandrel of the production tree. Thereafter, fluid is injected through the mandrel, into the production tubing of the tree, and then from the tree into the production tubing of the well. In one embodiment, the liquid may be scale squeeze liquid, although other types of fluid may be introduced by the same method.

While the invention has been shown or described in only some of its forms, it should be apparent to those skilled in the art that it is not so limited, but is susceptible to various changes without departing from the scope of the invention. For example, in addition to the parts of the production tree specifically discussed above, other known tree components may be included in the tree. For example, the tree may include chokes, hydraulic or electric control tines for the valves, etc. Similarly, this system can be integrated with other deep water packages. Furthermore, it is to be understood that the above disclosed embodiments are merely illustrative of the principles and applications of the present invention. Accordingly, numerous modifications may be made to the illustrative embodiments and other arrangements may be devised without departing from the spirit and scope of the present invention as defined by the appended claims.

What is claimed is:

1. A system for injecting fluids into a well, comprising:

A production tree having a mandrel at the top thereof and attached to the top of a well having production tubing, the mandrel having a mandrel bore therethrough, the tree having a production outlet passage arranged and designed to be in fluid communication with the production tubing of the well;

a production wing valve in the production outlet passage for selectively opening and closing the production outlet passage;

the tree having a tubing annulus passage extending from a tubing annulus surrounding the production tubing to a tubing annulus mandrel flowpath extending from the mandrel bore;

a mandrel flowpath valve for selectively opening and closing the tubing annulus mandrel flowpath;

the tree having a communication passage with a tubing annulus end that joins the tubing annulus passage at a point between the mandrel flowpath valve and the tubing annulus and a production passage end that joins the production outlet passage at a point between the production wing valve and the production tubing;

a fluid supply line attached to the mandrel of the tree above the tubing annulus mandrel flowpath, and in fluid communication with the production tubing via an injection flow path from the mandrel bore through the tubing annulus passage and the communication passage when the tree is in an injection mode with the mandrel flowpath valve open and the production wing valve closed;

a communication passage valve for selectively opening and closing the communication passage; and wherein the communication valve is open while the tree is in the injection mode and closed while the tree is in the production mode.

2. The system of claim 1, further comprising:

a connector positioned between, and attached to both the fluid supply line and the mandrel.

3. The system of claim 2, wherein the fluid supply line is connected to the production outlet passage of the tree by at least one fluid supply line port extending through the connector, and wherein the at least one fluid supply line has at least one fluid supply line valve positioned therein.

4. The system of claim 1, wherein while in the production mode, the production outlet passage is in communication with the production tubing with the production wing valve open and the mandrel port valve closed.

5. The system of claim 1, further comprising:

an annulus master valve in the tubing annulus passage between the tubing annulus and the tubing annulus end of the communication passage; and wherein the annulus master valve is closed while the tree is in the injection mode.

6. The system of claim 2, further comprising:

an emergency quick disconnect device attached between the fluid supply line and the connector.

7. The system of claim 1, further comprising:

a tubing hanger landed in the production tree, the tubing hanger being connected to the production tubing and having a tubing hanger passage in fluid communication with the production tubing and joining the production outlet passage;

a production master valve between the production outlet passage and the tubing hanger passage; and wherein:

the production master valve is open while the tree is in the injection mode.

8. The system of claim 1, wherein:

the mandrel has a cylindrical side wall extending around a mandrel bore axis; and portion of the tubing annulus mandrel flowpath extends downward within the side wall.

9. A scale squeeze injection system, comprising:

a production tree, comprising:

a first end having a mandrel with a mandrel bore and an annular external profile encircling a mandrel axis;

a second end having a production bore and attached to a well having production tubing in the well and a tubing annulus surrounding the production tubing;

a tubing annulus passage extending from the tubing annulus to a tubing annulus mandrel flowpath extending from the mandrel bore;

a tubing annulus master valve in the tubing annulus passage;

a tubing annulus access valve in the tubing annulus passage between the tubing annulus mandrel flowpath and the tubing annulus master valve;

a production outlet passage leading from the production tubing for connection to a flow line;

a production wing valve in the production outlet passage for selectively opening and closing the production outlet passage;

a crossover passage having a tubing annulus end that joins the tubing annulus passage at a point between the tubing annulus master valve and the tubing annulus access valve, the crossover passage having a production outlet passage end that joins the production outlet passage at a point between the production tubing and the production wing valve;

a crossover valve in the crossover passage;

a connector connects to the external profile of the mandrel;

a scale squeeze supply line attached to the connector so that the scale squeeze supply line is in fluid communication with the mandrel bore above the tubing annulus mandrel port; wherein the tree having an injection mode with the annulus access valve open, the tubing annulus master valve closed, the crossover valve open, and the production wing valve closed, defining a flow path communicating the fluid supply line with the production tubing via the mandrel bore, the tubing annulus mandrel flowpath, the tubing annulus passage, the crossover passage, and a portion of the production outlet passage between the production wing valve and the production tubing; and the tree having a production mode with the annulus access valve closed, the tubing annulus master valve closed, the crossover valve closed, and the production wing valve open, defining a flow path communicating the production tubing with the flow line.

10. The system of claim 9, wherein a portion of the tubing annulus passage between the tubing annulus mandrel flowpath and the tubing annulus access valve extends downward within a side wall of the mandrel.

11. The system of claim 9, further comprising:

a tubing hanger landed in the production tree below the tubing annulus mandrel flowpath, the production tubing being connected with the tubing hanger the tubing hanger having a tubing hanger bore concentric with the mandrel bore and a tubing hanger production passage leading from the tubing hanger bore to the production outlet passage;

a production master valve the tubing hanger production passage and the production outlet passage; and wherein the production master valve is open while the tree is in the injection mode.

12. The system of claim 9, wherein the connector and the fluid supply line are configured to be lowered subsea as a unit and connected to the mandrel.

13. The system of claim 9, further comprising:

an emergency quick disconnect device attached between the scale squeeze supply line and the connector.

14. The system of claim 9, wherein the production tree is a horizontal tree.

15. The system of claim 9, further comprising a fluid supply line valve in the fluid supply line.

16. A method of injecting fluid into a well, comprising:

providing a production tree with a mandrel having a mandrel bore, a production outlet passage, a production wing valve in the production outlet passage, a tubing annulus passage leading to the tubing annulus mandrel flowpath extending from the mandrel bore, an annulus access valve in the tubing annulus passage, and a crossover passage having a tubing annulus end that joins the tubing annulus passage and a production passage end that joins the production outlet passage;

connecting the production tree to a well so that the production outlet passage of the tree is in fluid communication with production tubing in the well and a tubing annulus surrounding the production tubing is in fluid communication with the tubing annulus passage;

connecting a fluid supply line to an upper portion of the mandrel of the tree;

opening the annulus access valve and closing the production wing valve, providing an injection mode fluid path from the fluid supply line into the mandrel bore, through the tubing annulus mandrel flowpath, the tubing annulus passage and the crossover passage to the production outlet passage and into the production tubing;

while in the injection mode, injecting fluid through the fluid supply line, into the production outlet passage of the tree, and into the production tubing of the well; and closing the annulus access valve and opening the production wing valve, providing a production mode fluid path from the production tubing through the production wing valve.

17. The method of claim 16, further comprising:

providing the tree with a tubing annulus master valve between the tubing annulus and the crossover passage; and closing the tubing annulus master valve while, the tree is in the injection mode and in the production mode.

* * * * *